US006562138B1

(12) United States Patent
Haas

(10) Patent No.: US 6,562,138 B1
(45) Date of Patent: May 13, 2003

(54) ELECTRODE HOLDER FOR A POWDER SPRAY GUN

(75) Inventor: Gerald Haas, St. Gallen (CH)

(73) Assignee: ITW Gema AG, St. Gallen (CH)

( * ) Notice: Subject to any disclaimer, the term of this patent is extended or adjusted under 35 U.S.C. 154(b) by 0 days.

(21) Appl. No.: 09/763,352

(22) PCT Filed: Jun. 9, 1999

(86) PCT No.: PCT/EP99/03963

§ 371 (c)(1),
(2), (4) Date: Feb. 21, 2001

(87) PCT Pub. No.: WO00/10722

PCT Pub. Date: Mar. 2, 2000

(30) Foreign Application Priority Data

Aug. 22, 1998 (DE) ..... 198 38 278

(51) Int. Cl.[7] ..... B05B 5/025
(52) U.S. Cl. ..... 118/625; 118/623; 361/230
(58) Field of Search ..... 118/620, 621, 118/623, 625, 627, 629, 308; 239/690, 708, 706, 3; 96/62, 73; 55/DIG. 38; 361/226, 227, 230, 235

(56) References Cited

U.S. PATENT DOCUMENTS 3,964,683 A * 6/1976 Gimple ..... 239/3
4,993,645 A * 2/1991 Buschor ..... 239/708
5,759,271 A * 6/1998 Buschor ..... 118/308

FOREIGN PATENT DOCUMENTS

DE 26 39 116 A 3/1977
GB 2 209 729 A 5/1989

* cited by examiner

*Primary Examiner*—Richard Crispino
*Assistant Examiner*—Y T Tadesse
(74) *Attorney, Agent, or Firm*—Lowe Hauptman Gilman & Berner, LLP

(57) ABSTRACT

A spray coating device for coating powder, comprising an electrode support (24) fitted with an electrically insulating tubular segment (26) running at least 1.5 cm from an electric contactor (34) into a powder duct (8).

27 Claims, 1 Drawing Sheet

2
4
6
8
10
12
14
16
18
20
22
24
26
28
30
32
34
36
38
40
42
44
46
48
52
54
56
58
60
62

ELECTRODE HOLDER FOR A POWDER SPRAY GUN

FIELD OF THE INVENTION

The invention relates to a spray coating device for a coating powder containing a powder duct, an electrode support mounted in the downstream end zone of the powder duct, an electrically insulating, integral tubular segment constituting a segment of the powder duct, and an electric contactor for setting up contact between a high-voltage conductor and an electric connecting line running through the electrode support to at least one high-voltage electrode supported by the electrode support.

BACKGROUND OF THE INVENTION

A spray coating device of this kind is known from the European patent document 0 383 030 B1. It contains an electrode support fitted with a centering ring which is only about 3 mm long and which is inserted from the front into the downstream end of a powder duct of the spray coating device for the purpose of centering the electrode support.

To prevent electromagnetic fields or forces in the powder duct of the spray coating device from adversely acting on powder movement and spray coating, the high-voltage space between a high-voltage generator and at least one high-voltage electrode must be well screened from the electrode in order that only the electrode shall electrostatically charge the coating powder. Moreover leakage currents between the high-voltage conductive path and other components, for instance the powder duct, are unwanted because entailing loss of energy and moreover because they might lead to undesirably electrostatically charging the powder particles in the powder duct, in turn resulting possibly in powder deposits in the powder duct and in special cases in powder dust "migrating" along the path of the leakage current. The larger the thickness of the electrically insulating material between the high-voltage conducting parts and the powder duct, the better the electrical insulation. However increasing the thickness of such an insulator conflicts with minimizing the bulk of the spray coating device and its weight.

SUMMARY OF THE INVENTION

The objective of the invention is to solve the problem of averting electric leakage currents and undesired electromagnetic fields between the high-voltage conducting parts and the coating powder in the powder duct of the spray coating device without entailing a bulkier and/or heavier spray coating device.

The above and other objectives of the present invention is achieved by setting the axial distance between the electric contactor and the rear end of the rear tubular segment to be at least 1.5 cm. Preferably, the axial distance is less than or equal to 4 cm. More preferably, the axial distance is in the range of from 2 to 3 cm.

In accordance with an aspect of the present invention, a channel is formed in a rearward-pointing offset of the tubular segment to annularly enclose, while being radially spaced from, the powder duct. The channel communicates on one hand with a compressed-air duct and on the other hand with an air duct running through the electrode support for feeding compressed air to the electrode.

BRIEF DESCRIPTION OF THE DRAWINGS

The invention is described below in relation to a preferred embodiment and to the drawings.

DETAILED DESCRIPTION OF THE DRAWINGS

Figures 1, 2, 3:
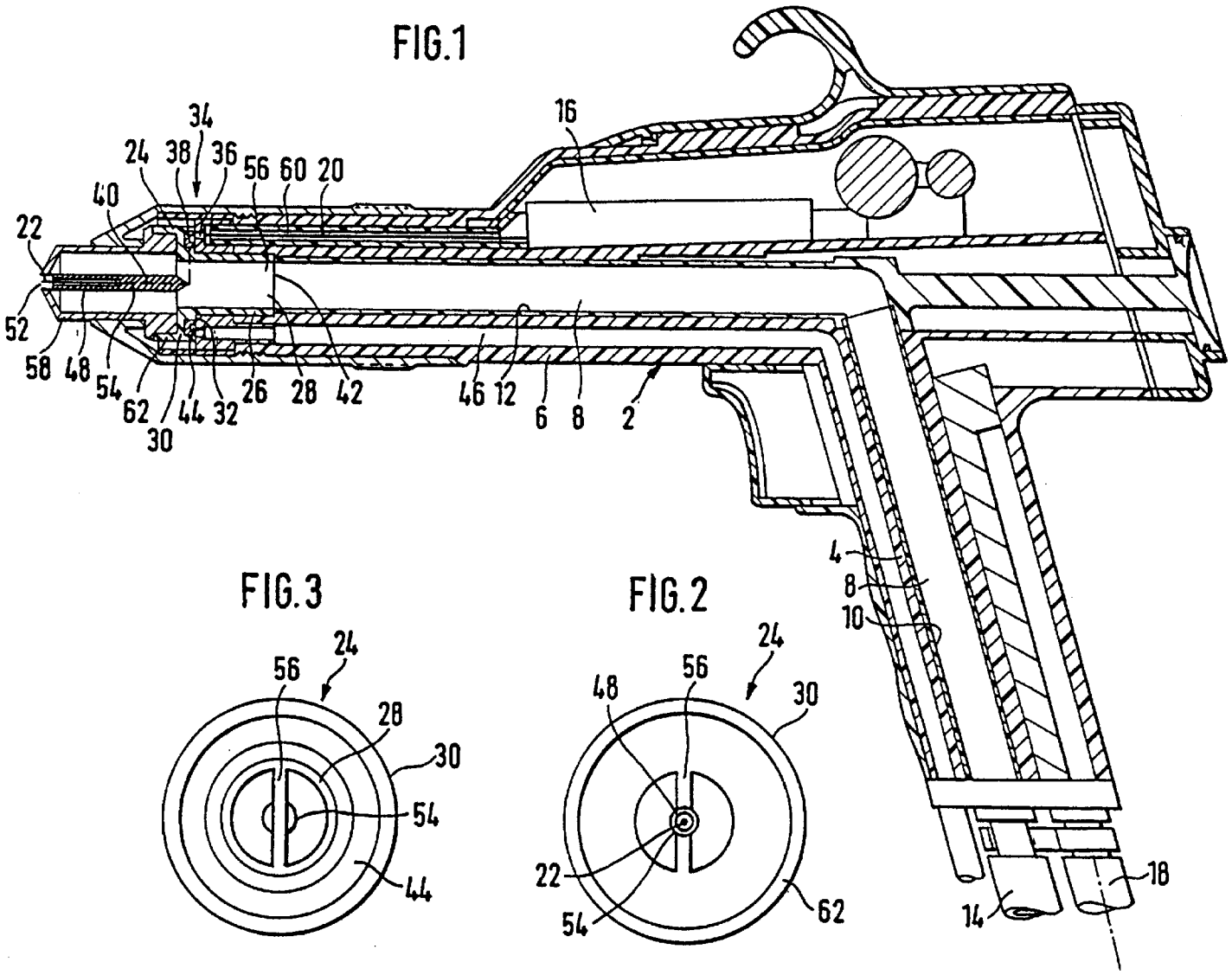
FIG. 1 is a longitudinal section of a pistol-like spray coating device of the invention.
FIG. 2 is a front view of a front end surface of an electrode support of the spray coating device of the invention.
FIG. 3 is a rear view of the rear end face of the electrode support of FIG. 2.

The spray coating device of the invention shown in FIG. 1 comprises an integral housing 2 which is made of an electrically insulating material and which constitutes a grip 4 and a barrel 6. A powder duct 8 subtended by a tubular grip 10 and a tubular barrel 12 runs through the housing 2, said grip and barrel being joined at an angle less than 180° corresponding to the angle subtended between the grip 4 and the barrel 6. A powder hose 14 to feed coating powder is connected to the powder duct 8.

A high-voltage generator 16 to generate a high voltage in the range between 10 kv and 140 kv or another potential is mounted inside a chamber of the housing 2 and is connected at its primary side to a low-voltage cable 18 affixed to the housing 2 and on its secondary side by means of an electric conductor 20 to a high-voltage electrode 22.

An electrode support 24 constitutes a downstream end zone of the powder duct 8. This electrode support 24 comprises a tubular segment 26 inserted from the front into the housing 2, its inside diameter tightly adjoining the inside diameter of the barrel tubular segment 12. The tubular segment 26 is an integral electrically insulating element and comprises a rear, upstream tubular segment 28 of an outside diameter which is less than a forward, adjoining tubular stub 30. A radial offset 32 is subtended between tubular segment 28 and the tubular stub 30.

An electric contactor 34 is mounted on said offset 32. This contactor contains an electric contact point 36 connected to the high-voltage conductor 20 and a contact point 38—mounted on the offset 32—which shall contact, as required, said contact point 36. This electric contact point 38 is connected by an electric connecting line 40 running through the tubular segment 26 to the minimum of one electrode 22.

The axial distance between the electric contactor 34 and the rear end 42 of the rear tubular segment 28 is at least 1.5 cm, preferably at most 4 cm, and in the preferred embodiment it is between 2.0 and 3.0 cm, and therefore preferably approximately 2.5 cm.

A channel 44 is present in the rearward-pointing offset 32 and encloses the powder duct 8 at an annular, radially spaced distance; said channel 44 is connected in flow-transmitting manner on one hand to the front end of a compressed-air duct 46 running through the housing 2 and on the other hand to an air duct 48 running through the electrode support 24.

The tip of the electrode 22 projects by a few mm from the air duct 48 and is situated upstream in the vicinity of the spray-nozzle mouth 52. The end zone of the air duct 48 containing the electrode 22 is constituted by a tubular stub 54 of the electrode support 24 running axially forward from a strip 56. This strip 56 runs diametrically through the tubular segment 26 which is inserted from the front into the housing 2.

Jointly, all parts of the electrode support 24 amount to an integral component made of an electrically insulating material such as a plastic. Jointly with the electrode support 24, the electrode 22 and the electrical conducting line 40 and contact point 38, the electrode support 24 is one exchangeable unit mounted between a nozzle case 58 of the spray nozzle 52 and the housing 2. Exchanging the electrode support 24 only requires removing a coupling nut 60 from the front end of the barrel 6, whereby the nozzle case 58 releases the electrode support 24.

The nozzle case 58 is inserted from the front into an integral tubular stub 62 running forward from the tubular segment 30 of larger outside diameter.

What is claimed is:

1. A spray coating device for coating an object with a powder, said device comprising:

a powder duct (8);

an electrode support (24) mounted in a downstream end zone of the powder duct;

an electrically insulating, integral tubular segment (26) constituting a segment of the powder duct, said tubular segment having a rear, upstream tubular segment (28) and a front, downstream, adjoining tubular segment (30), said front segment (30) having an outside diameter larger than that of the rear adjoining segment (28 ) thereby defining a rearward facing offset (32); and an electric contactor (34) for setting up contact between a high-voltage conductor (20) and an electric connecting line (40) running through the electrode support (24) to at least one high-voltage electrode (22) that is supported by the electrode support, the contactor (34) being mounted on the rearward facing offset (32);

wherein an axial distance between the electric contactor (34) at the rearward facing offset (32) and a rear end face of the rear segment (28) is at least 1.5 cm; and wherein a channel (44) is formed in the rearward facing offset (32) to annularly enclose, while being radially spaced from, the powder duct (8) , said channel communicating a compressed-air supply duct (46) and an air duct (48) running through the electrode support (24) for feeding compressed air to the electrode (22).

2. Spray coating system as claimed in claim 1, wherein the axial distance is not longer than 4 cm.

3. Spray coating device as claimed in claim 1, wherein the axial distance is in the range of from 2 cm to 3 cm.

4. Spray coating device as claimed in claim 1, further comprising a tubular stub (62) projecting integrally from said front segment (30) forwards.

5. Spray coating device as claimed in claim 4, further comprising a spray nozzle (58) having a rear portion being inserted into the tubular stub (62).

6. Spray coating device as claimed in claim 1, further comprising:

an integral strip (56) running through the tubular segment (26); and at a central region of the powder duct (8), a tubular stub (54) that projects forward from said strip and supports the electrode (22).

7. Spray coating device as claimed in claim 1, wherein the electrode support (24) is exchangeably inserted from the front into a housing (2) containing the powder duct (8).

8. An electrode unit adapted to be removably fitted to a downstream end of a powder duct of a powder spray coating device, said electrode unit comprising:

a tubular element made of an electrically insulating material and configured to constitute an extension of the powder duct, said tubular element comprising a rear, upstream segment and a front, downstream segment adjoining said rear segment, said front segment having a radial extent greater than that of said rear segment thereby defining a flange having a rearward facing face;

at least one electrode supported by said tubular element; and an electrical contact point formed in said front segment and exposed from the rearward facing face of said flange, said contact point being electrically connected to said electrode and adapted to come into contact with a matching contact point of the powder spray coating device, when said electrode unit is fitted to the downstream end of the powder duct so as to electrically connect said electrode with a power source of the powder spray coating device;

wherein a distance, as measured axially of said tubular element, between the rearward facing face of said flange and a rear end face of said rear segment is at least 1.5 cm.

9. The electrode unit of claim 8, wherein said distance is not longer than 4 cm.

10. The electrode unit of claim 8, wherein said distance is in the range of from 2 cm to 3 cm.

11. The electrode unit of claim 8, further comprising a tubular ridge projecting integrally from a front end face of said front segment forwards, said ridge and said front segment together defining a space for receiving an end of a nozzle case of the powder spray coating device whereby said electrode unit is clamped between the downstream end of the powder duct and the nozzle case.

12. The electrode unit of claim 8, further comprising a strip connected to said tubular element and extending across an interior of said tubular element;

a protrusion that projects forward from a middle region of said strip and supports said electrode.

13. The electrode unit of claim 12, wherein said strip, said protrusion and said rear and front segments of said tubular element are all made integrally into a single electrically insulating body, said strip running diametrically through said tubular element.

14. The electrode unit of claim 13, wherein said protrusion and said electrode extend substantially along an axis of said tubular element.

15. The electrode unit of claim 12, wherein a front end portion of said protrusion is made hollow to define therein an air duct, said electrode extending within said air duct and axially projecting beyond a forward-most end face of said protrusion.

16. The electrode unit of claim 15, further comprising an annular channel formed in said front segment and communicated with said air duct, for feeding compressed air from a compressed-air supply of the powder spray coating device to said air duct and said electrode.

17. The electrode unit of claim 16, wherein said channel is open to the rearward facing face of said flange for communicating with the compressed-air supply.

18. A powder spray coating device, comprising:

a housing;

a powder duct accommodated in said housing and having an upstream end connected to a powder container and an opposite downstream end;

an electrode unit removably fitted to the downstream end of said powder duct, said electrode unit comprising:

a tubular element made of an electrically insulating material and configured to constitute an extension of the powder duct, said tubular element comprising a rear, upstream segment and a front, downstream segment adjoining said rear segment, said front segment having a radial extent greater than that of said rear segment thereby defining a flange having a rearward facing face;

at least one electrode supported by said tubular element; and an electrical contact point formed in said front segment and exposed from the rearward facing face of said flange, said contact point being electrically connected to said electrode; and a matching contact point formed in said housing and arranged to come into contact with said electrical contact point when said electrode unit is fitted to the downstream end of said powder duct so as to electrically connect said electrode with a power source via said contact points;

wherein a distance, as measured axially of said tubular element, between the rearward facing face of said flange and a rear end face of said rear segment is at least 1.5 cm.

19. The device of claim 18, wherein said distance is not longer than 4 cm.

20. The device of claim 18, wherein said distance is in the range of from 2 cm to 3 cm.

21. The device of claim 18, further comprising a tubular ridge projecting integrally from a front end face of said front segment forwards; and a nozzle case fastened to said housing;

wherein said ridge and said front segment together define a space for receiving an end of said nozzle case so that said electrode unit is clamped between the downstream end of the powder duct and the nozzle case.

22. The device of claim 18, wherein said electrode unit further comprises:

a strip connected to said tubular element and extending across an interior of said tubular element;

a protrusion that projects forward from a middle region of said strip and supports said electrode.

23. The device of claim 22, wherein said strip, said protrusion and said rear and front segments of said tubular element are all made integrally into a single electrically insulating body; and said strip runs diametrically through said tubular element.

24. The device of claim 23, wherein said protrusion and said electrode extend substantially along an axis of said tubular element.

25. The device of claim 22, wherein a front end portion of said protrusion is made hollow to define therein an air duct, said electrode extending within said air duct and axially projecting beyond a forward-most end face of said protrusion.

26. The device of claim 25, further comprising a compressed-air supply duct; and an annular channel formed in said front segment and communicated with said air duct and said compressed-air- supply duct, for feeding compressed air from said compressed-air supply duct to said air duct and said electrode.

27. The device of claim 26, wherein said channel is open to the rearward facing face of said flange to communicate with said compressed-air supply duct.

* * * * *